US009540745B2

(12) United States Patent
Stelzer et al.

(10) Patent No.: US 9,540,745 B2
(45) Date of Patent: Jan. 10, 2017

(54) METHOD AND DEVICE FOR GRINDING STRAND-LIKE FIBROUS MATERIAL

(71) Applicant: The Procter & Gamble Company, Cincinnati, OH (US)

(72) Inventors: Norbert Stelzer, Schwallbach (DE); Olaf Schwarz, Neumünster (DE); Ingo Mahlmann, Itzehoe (DE)

(73) Assignee: The Procter & Gamble Company, Cincinnati, OH (US)

( * ) Notice: Subject to any disclaimer, the term of this patent is extended or adjusted under 35 U.S.C. 154(b) by 436 days.

(21) Appl. No.: 14/158,399

(22) Filed: Jan. 17, 2014

(65) Prior Publication Data

US 2014/0131495 A1 May 15, 2014

Related U.S. Application Data

(63) Continuation of application No. 13/762,757, filed on Feb. 8, 2013, now Pat. No. 8,733,678.

(30) Foreign Application Priority Data

Mar. 5, 2012 (WO) ..... PCT/US12/027678

(51) Int. Cl.
*B02C 18/18* (2006.01)
*D01B 9/00* (2006.01)
*B02C 18/14* (2006.01)

(52) U.S. Cl.
CPC ..... *D01B 9/00* (2013.01); *B02C 18/145* (2013.01); *B02C 2018/188* (2013.01)

(58) Field of Classification Search
CPC ..... B02C 18/145; B02C 18/18; B02C 18/22; B02C 18/2225; B02C 2018/188; D01B 9/00
USPC ..... 241/189.1, 222, 196.4, 186.2
See application file for complete search history.

(56) References Cited

U.S. PATENT DOCUMENTS 3,662,964 A 5/1972 Rossler
3,728,922 A * 4/1973 Off ..... D05B 35/02 83/236
4,615,490 A 10/1986 Goldhammer
5,046,220 A 9/1991 Pierret et al.
(Continued)

OTHER PUBLICATIONS

International Search Report PCT/US2012/027678, dated Mar. 5, 2012, 8 pages.

*Primary Examiner* — Faye Francis
(74) *Attorney, Agent, or Firm* — Andres E. Velarde

(57) ABSTRACT

A method and a device for grinding strand-like fibrous material, wherein the strand-like fibrous material is fed towards the cutting edge of a cutting mechanism and wherein a moveable striking mechanism for grinding the fibrous material cooperates with the cutting mechanism. Associated with the cutting mechanism is a moveable clamping mechanism, by means of which the fibrous material is clamped in an oscillating manner. To produce optimally uniform fibrous shreds, as defined by the position of the cutting edge, the fibrous material is guided through an oscillating clamping gap formed between the clamping mechanism and the cutting mechanism, wherein the clamping mechanism is guided in a back and forth clamping movement relative to the cutting mechanism. For this purpose, the clamping gap is formed by arranging the clamping mechanism and the cutting mechanism opposite one another in a clamping plane.

10 Claims, 6 Drawing Sheets

(56) References Cited

U.S. PATENT DOCUMENTS

| | | | | |
|---|---|---|---|---|
| 5,374,316 | A | 12/1994 | Tilby | |
| D611,652 | S | 9/2000 | Fisher et al. | |
| 8,628,456 | B2 * | 1/2014 | Stelzer | B31F 7/00 493/340 |
| 2003/0167891 | A1 * | 9/2003 | Bascom | D01G 1/04 83/495 |
| 2014/0197255 | A1 * | 7/2014 | Reif | B02C 18/148 241/27 |

* cited by examiner

METHOD AND DEVICE FOR GRINDING STRAND-LIKE FIBROUS MATERIAL

CROSS REFERENCE TO RELATED APPLICATION

This application is a continuation of U.S. patent application Ser. No. 13/762,757, filed Feb. 8, 2013 that claims priority to PCT/US12/027678, filed Mar. 5, 2012; both incorporated herein in their entirety.

FIELD OF THE INVENTION

The disclosure relates to a method for grinding strand-like fibrous material according to the preamble of claim 1 as filed, and to a device for performing the method according to the preamble of claim 8 as filed.

BACKGROUND OF THE INVENTION

It is generally known that, in order to manufacture a non-woven fabric using an airlaid process, the fibers and fibrous shreds used in the process are produced beforehand by grinding a strand-like fibrous material. Notably, natural fibers such as those made from cellulose are manufactured from this type of fibrous web. The grinding and shredding preferably takes place in what are referred to as hammer mills, where the fibrous material is fed onto the transversely aligned cutting edge of a cutting mechanism and wherein several striking elements arranged on a drum strike one end of the fibrous material projecting over the cutting edge.

A device of this type and a method of this type are, for example, already known from DE 22 45 819 A1. In the known device, the cutting edge is formed into a casing by a slotted inlet opening which encases a drum body with a plurality of striking elements. In this process, the striking elements are advanced to the inner end of the slot leaving a narrow clearance, such that the incoming fibrous material is ground by the rotating drum body. Devices of this type have the great disadvantage that very irregular fibrous shreds are produced where relatively elastic fibrous materials are used. Due to the elasticity of the fibrous material, the breaks in the fibrous material occur primarily beyond the cutting edge.

In the prior art, therefore, a method and a device are known with which the fibrous material is immobilized by an additional clamping mechanism in the region of the cutting edge. The known method and the known device are described in EP 0 386 017 B1. Here, the fibrous material is fed to the cutting edge of the cutting mechanism. A clamping mechanism is arranged at a short distance from the cutting mechanism, which features two opposing clamping jaws that grip on the lower surface and the upper surface of the fibrous material. One of the clamping jaws is designed to be moveable and this results in the fibrous material being clamped in an oscillating manner. Hence, this lends additional stability to the fibrous material during grinding.

The known method and the known device, however, have a great disadvantage insofar as the point in time at which the fibrous material is clamped and the point in time at which the fibrous material is ground must be synchronized with each other in order to obtain fibrous shreds in defined sizes. Furthermore, it is impossible with the known method and device to produce very fine fibrous shreds because of the interval as designed between the cutting mechanism and the clamping mechanism.

Thus, the object of the disclosure is to develop a generic method for grinding fibrous materials and a generic device for performing the method, such that the fibrous material can be continuously ground into very fine fibrous shreds.

A further aim of the disclosure is to produce an optimally continuous grinding process with a continuous material feed.

SUMMARY OF THE INVENTION

This object is achieved according to the present disclosure with a method in which the fibrous material is fed through a clamping gap between the clamping mechanism and the cutting mechanism, which is designed to oscillate, wherein the clamping mechanism is guided in a back and forth clamping movement relative to the cutting mechanism.

In the device according to the present disclosure, the solution is achieved by the clamping mechanism and the cutting mechanism being arranged opposite one another in a clamping plane in order to form a clamping gap, wherein the clamping mechanism may be guided in a back and forth clamping movement relative to the cutting mechanism.

Further advantageous refinements of the disclosure are defined by the features and feature combinations of the respective dependent claims.

DETAILED DESCRIPTION OF THE INVENTION

Figure 1:
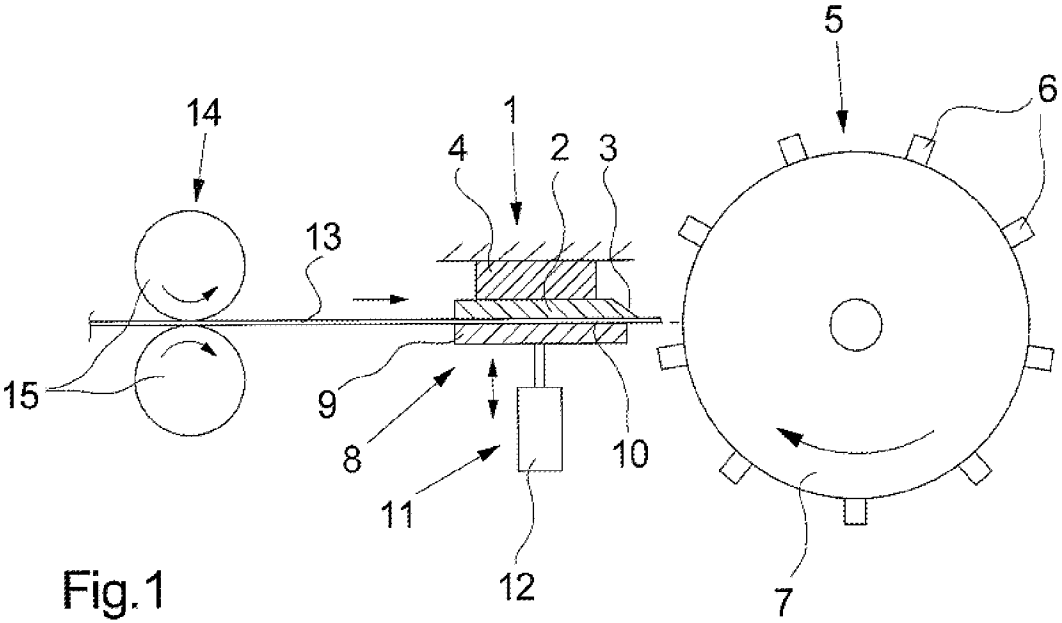
FIG. 1 is a schematic view of a first embodiment of the device according to the present disclosure for carrying out the method according to the present disclosure.

The disclosure has a particular advantage insofar as the fibrous material is immobilized directly at the cutting edge of the cutting mechanism during grinding. Consequently, the fibrous material may be ground uniformly into very fine fibrous shreds. Undefined breaks in the material beyond the cutting edge are prevented.

The cutting mechanism and the clamping mechanism act on the fibrous material in one clamping plane such that the fibrous material is immobilized on its upper surface and on its lower surface in the region of the cutting edge. Depending on the lay direction, the cutting edge can be formed on the upper surface or on the lower surface of the fibrous material. Accordingly, the clamping mechanism would be arranged on the lower surface or the upper surface of the fibrous material.

In order to maintain a continuous process with ground fibers exhibiting optimally uniform fiber quality in spite of the fibrous material being clamped, the method variation is particularly preferred in which the fibrous material is also transported by a feeding movement of the clamping mechanism relative to the cutting mechanism. Advantageously, the fibrous material may be continuously advanced in the phases in which there is no clamping.

In order to perform the variation according to the present disclosure, a further modification of the device according to the present disclosure features a mechanical linkage by which the clamping mechanism is guided in order to perform a superimposed advancing movement. Hence, multiple degrees of freedom of movement at the clamping mechanism may be produced by a drive.

In order to guarantee optimally consistent material feeding and consistent clamping of the fibrous material, it is preferable to use the variant method in which the fibrous material is clamped in the clamping gap by multiple movable clamping jaws of the clamping mechanism opposite the cutting mechanism, wherein a number of the clamping jaws are moved asynchronously in parallel and a number of the clamping jaws are moved synchronously. Thus, the clamping movements and the advancing movements of the clamping jaws may be made by the clamping jaws moving asynchronously. The synchronously moving clamping jaws, which are spread advantageously over the width of the clamping gap, guarantee immobilization as well as a continuous grinding of the fibrous material at the cutting edge of the cutting mechanism.

The device according to the present disclosure features a cutting mechanism for this purpose with multiple clamping jaws which may be moved in parallel, wherein the clamping jaws are divided into a number of drive units and where the clamping jaws of adjacent drive units may be moved asynchronously and the clamping jaws of one of the drive units may be moved synchronously. Dividing the clamping jaws into multiple drive units has the particular advantage that the interaction of the advancing movement and the clamping movement may be produced evenly distributed over the width of the fibrous material. Hence, very large working widths of fibrous material may also be advantageously ground into fibrous shreds.

In order to produce a uniform movement of the fibrous material, the variation of the method of the disclosure is particularly advantageous in which each of the clamping jaws of the clamping mechanism are moved for clamping and for transporting the fibrous material on an elliptical guide path. Hence, the clamping jaws may accomplish a cyclic movement, with which the fibrous material may be continually advanced in the clamping gap. Here, the advancing movement of the clamping jaws essentially determines the length of the ellipse.

Hence, according to a further advantageous modification of the device according to the present disclosure, the mechanical linkage to the clamping jaw drive is designed so that that each of the clamping jaws of the clamping mechanism are movable on an elliptical guide path.

In order to be able to produce a predetermined quantity of fibers per unit time where fibrous materials and fibrous shreds differ each time, it is also provided that the movement of the clamping jaws of the clamping mechanism is produced by a powered drive shaft with a controllable electric motor. Hence, the actual advancing movement of the fibrous material may be easily adjusted via a rotational speed control for the drive shaft input speed.

In order to perform the method variation according to the present disclosure, the modification of the device of the present disclosure features a drive shaft connected to the mechanical linkage, which is connected to a controllable electric motor and a controller. The drive shaft, and hence the mechanical linkage, may be operated at a predetermined rotational speed using the controller and the electric motor.

In order to be able to grind different fibrous materials, a variation of the method is preferably used, in which the clamping gap between the cutting mechanism and the clamping mechanism is adjusted by setting the spacing for the clamping mechanism to the particular thickness of the fibrous material. Hence, notably, the clamping forces acting on the fibrous material may be adjusted such that, along with immobilization, advancing the fibrous material in the clamping gap is also possible.

In order to fragment the fibrous material, a variation of the method is particularly advantageous in which the fibrous material is fragmented at the cutting edge of the cutting mechanism by multiple striking elements attached to a rotating drum, which passes at a short distance from the cutting edge. Hence, fine fibrous shreds may also be produced where the feeding movements of the fibrous material are relatively high. The striking elements may be operated with a relatively high striking frequency, relative to the cutting edge of the cutting mechanism.

In order to convey the fibrous material in the clamping gap right up to the cutting edge, the clamping jaws of the clamping mechanism are preferably designed according to a further advantageous modification of the device according to the present disclosure, in which the clamping jaws feature a guide section and a clamp section. Here, the clamp section of the clamping jaw extends parallel to a knife plate forming the cutting edge of the cutting mechanism, where, however, the guide section of the clamping jaw is connected to gear elements of the mechanical linkage by multiple pivots.

One of the gear elements is preferably designed as a connecting rod, which is connected to the drive shaft via an eccentric plate, and to the clamping jaw via the pivot. This advantageously allows an oscillating advancing movement to be produced at the clamping jaw. In the process, the superimposed clamping movement is advantageously transferred to the clamping jaw via a cam disk, which cooperates with a guide surface at the guide section of the clamping jaw.

In order to maintain the movement of the clamping jaw in a straight alignment to the clamping gap, provision has also been made for the guide section of the clamping jaw to be connected via a further pivot on one lead end to one of multiple sliding blocks, which is guided on a guide rail.

The clamping jaws are advantageously designed as bars such that one clamp end on the clamp section faces the lead end of the guide section. In this respect, to adjust the clamping gap, it is advantageous for the guide rail of the sliding blocks to be cradled in a height-adjustable rail support whose height determines the distance between one clamp end of the clamping jaw and the knife plate.

The method according to the present disclosure and the device according to the present disclosure are particularly suitable for producing very fine fibers from fibrous materials relatively quickly with a high degree of uniformity. Hence, the fibrous shreds produced are particularly suitable for laying down as a mat of fibers immediately after grinding. The strand-like fibrous material may be produced as a lap or as a stack of fiberboards.

The disclosure is explained in greater detail below by means of a number of embodiments of the device according to the present disclosure for performing the method according to the present disclosure, with reference to the attached figures.

In FIG. 1, a first embodiment of the device according to the present disclosure for carrying out the method according to the present disclosure for grinding a strand-like fibrous material is shown schematically in a cross-sectional view. The embodiment features a fixed cutting mechanism 1, on one free end of which is formed a cutting edge 3. In this embodiment, the cutting mechanism 1 is designed as a knife plate 2, on one free end of which the cutting edge 3 is formed. The knife plate 2 is arranged on a plate support 4.

A clamping gap 10 is formed by arranging a movable clamping mechanism 8 on the cutting mechanism 1. In this embodiment, the clamping mechanism 8 is designed as an oblong clamping jaw 9, which together with the opposing knife plate 2 forms the clamping gap 10. The clamping jaw 9 extends essentially as far as the cutting edge 3 of the knife plate 2. The clamping jaw 9 is connected to a clamp drive 11, which, in this embodiment, is designed as a linear drive 12. The linear drive 12 guides the clamping jaw 9 in a back and forth clamping movement relative to the knife plate 2, such that the fibrous material 13 advanced between the knife plate 2 and the clamping jaw 9 is clamped in an oscillating manner.

Associated with the cutting mechanism 1 is a striking mechanism 5, which is positioned a short distance from the cutting edge 3. In this embodiment, the striking mechanism 5 is formed by a drum 7 and a plurality of striking elements 6, which are uniformly arranged about the circumference of the drum 7. The striking elements 6 are moved by the drum 7 on a revolving guide plane at a short distance from the cutting edge 3 of the cutting mechanism 1.

A feed mechanism 14, by which the fibrous material 13 is advanced into the clamping gap 10 between the cutting mechanism 1 and the clamping mechanism 8, is arranged on the cutting mechanism 1, on the side opposite the striking mechanism 5. The feed mechanism 14 is designed as two powered feed drums 15, which act on the fibrous material 13 in a conveyor gap.

In the embodiment of the device according to the present disclosure for carrying out the method of grinding strand-like fibrous material according to the present disclosure shown in FIG. 1, the fibrous material 13 is initially fed into the cutting mechanism 1 via the feed drums 15. The fibrous material 13 is fed through the clamping gap 10 towards the striking mechanism 5. Here, the free end of the fibrous material 13 is continuously broken up and ground into shreds by the striking elements 6 positioned on the drum 7. In order to obtain an optimally defined reduction and degradation of the fibrous shreds, the clamping mechanism 8 facing the cutting edge 3 is oscillated back and forth, such that the fibrous material is immobilized by oscillating clamping, right to the cutting edge 3 in the clamping gap 10. Here, a clamping frequency predetermined by the clamp drive 11 may be synchronized with a striking frequency determined by the drive of the drum 7, such that the striking elements 6 always strike the free end of the fibrous material 13 in a clamped condition. In the phase in which the clamping jaw 9 is guided by the linear drive in a reverse movement, the free end of the fibrous material 13 is repositioned by the advance of the feed mechanism 14. In this respect, a continual process for grinding the fibrous material takes place.

Figure 2:
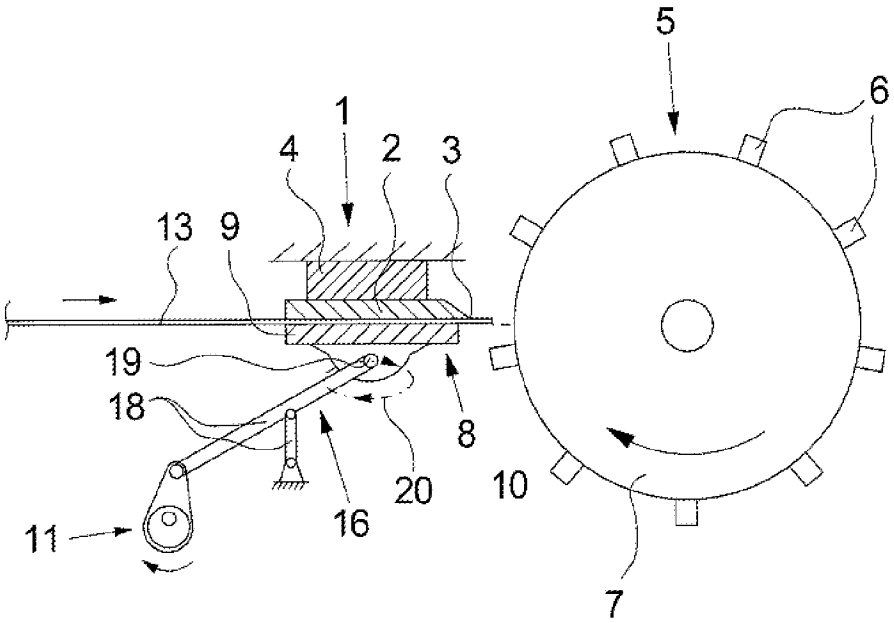
FIG. 2 is a schematic view of a further embodiment of the device according to the present disclosure.

A further embodiment of the device according to the present disclosure for carrying out the method according to the present disclosure for grinding strand-like fibrous materials is shown schematically in cross-section in FIG. 2. The design of the cutting mechanism 1 and of the striking mechanism 5 in this embodiment is identical to those in the above-mentioned embodiment, such that no further explanation is required for this purpose and reference is made to the above description.

Likewise, the clamping mechanism 8 is in the form of a clamping jaw 9, which, together with the knife plate 12, forms the clamping gap 10 for immobilizing the fibrous material 13. In the embodiment shown in FIG. 2, the clamp drive 11 features a drive shaft 17 and a mechanical linkage 16, wherein one of the gear elements is connected to the clamping jaw 9. The mechanical linkage 16 is connected to the drive shaft 17 and the clamping jaw 9 via the gear elements 18, such that the clamping jaw 9 performs a superimposed advancing movement in addition to a clamping movement. Hence, the clamping jaw 9 is guided on an elliptical guide path 20 relative to the knife plate 2. Hence, in addition to clamping the fibrous material 13 in the clamping gap 10, the oscillating movement of the clamping jaw 9 simultaneously causes the material to advance. The striking mechanism 5 may be operated at a higher striking frequency compared with the clamping frequency of the clamp drive 11.

In order to be able to accomplish substantially consistent clamping and consistent feed at the fibrous material 13, preferably multiple clamping jaws 9 are arranged in parallel side by side within a working width and powered by separate mechanical linkages in the embodiment shown in FIG. 2, wherein the adjacent mechanical linkages of the clamping jaws are driven one after the other.

Figure 3:
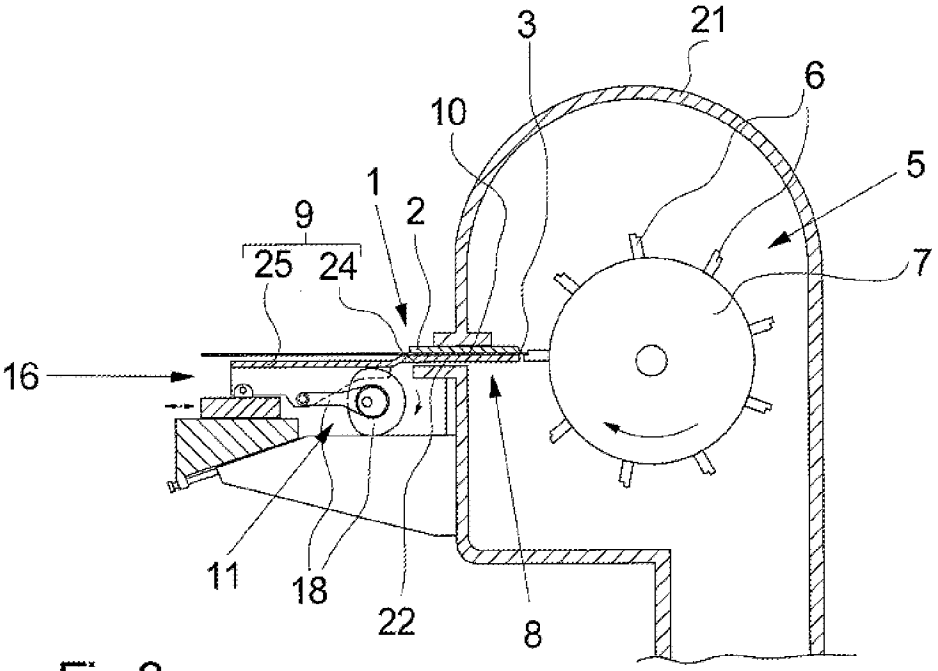
FIG. 3 is a schematic cross-sectional view of a further embodiment of the device according to the present disclosure.

A clamp drive for the clamping mechanism of this type is illustrated in greater detail below in an embodiment of the device according to the present disclosure in FIG. 3 and FIG. 4. In FIG. 3, the embodiment is shown in a schematic cross-sectional view and in FIG. 4, in a schematic plan view. Where no explicit reference is made to one of the figures, the following description applies to both figures.

The embodiment of the device according to the present disclosure for carrying out the method according to the present disclosure for grinding strand-like fibrous material shown in FIG. 3 is particularly suitable for larger working widths.

Figure 4:
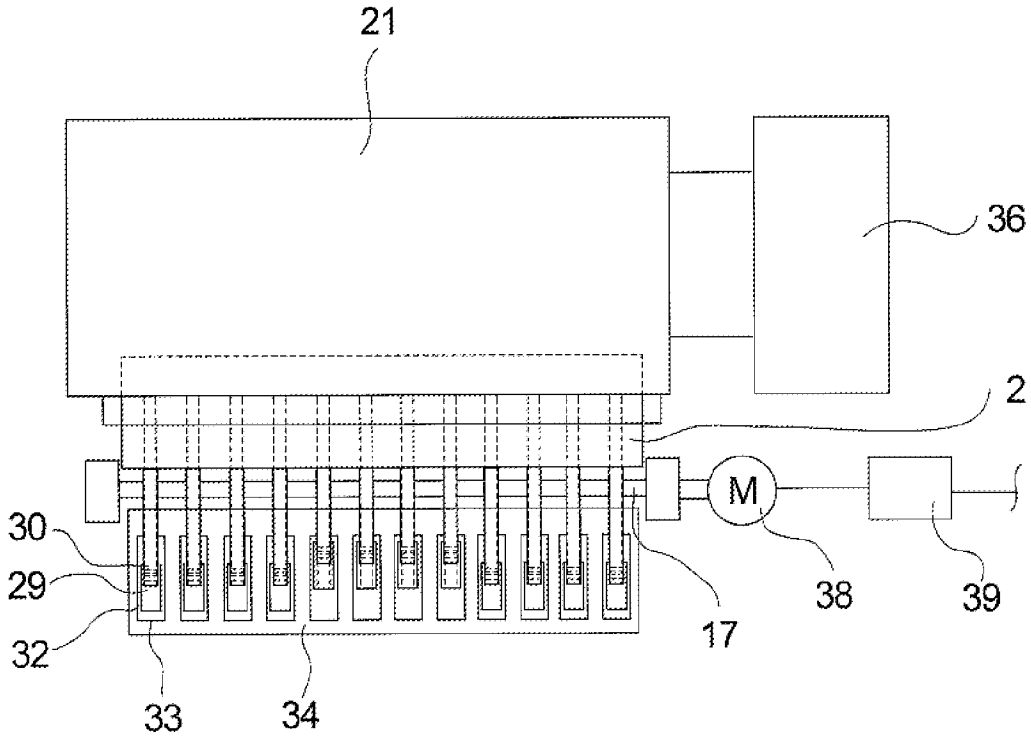
FIG. 4 is a schematic plan view of the embodiment in FIG. 3.

In the embodiment shown in FIGS. 3 and 4, the striking mechanism 5 is arranged inside a casing 21, whereby the striking mechanism is in the form of a powered drum 7 with a plurality of striking elements 6 projecting radially on the circumference of the drum 7. The ends of the drum 7 are rotatably mounted in the casing 21, with one end being connected to a drum drive 36.

On one side of the casing 21, a casing slot 22 extends parallel to the drum 7. The knife plate 2 of the cutting mechanism 1 is located in the casing slot 22 and the cutting edge 3 thereof projects inwards into the casing 21. The cutting edge 3 of the knife plate 2 terminates at a short distance from the striking elements 6. Here, the knife plate 2 is preferably designed to be adjustable, in order to be able to set a defined clearance between the cutting edge and the striking element 6.

Within the casing slot 22, a plurality of individually movable clamping jaws 9 are arranged at the knife plate 2. The clamping jaws 9 are designed identically and each is connected to a clamp drive 11.

Figure 5:
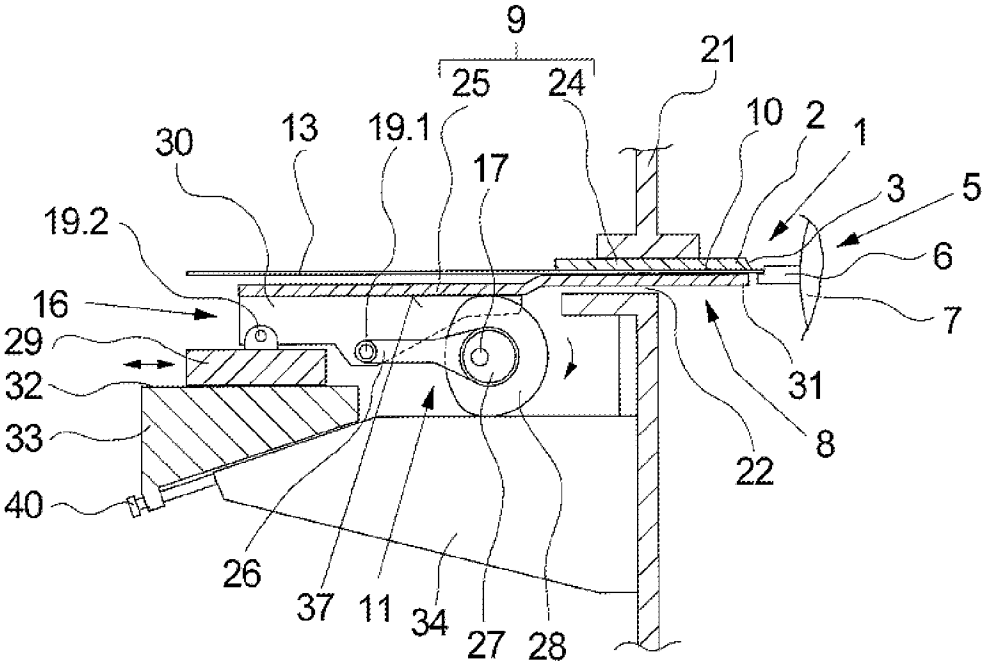
FIG. 5 is a schematic cross-sectional view of the clamping mechanism of the embodiment in FIG. 3.
Figure 6:
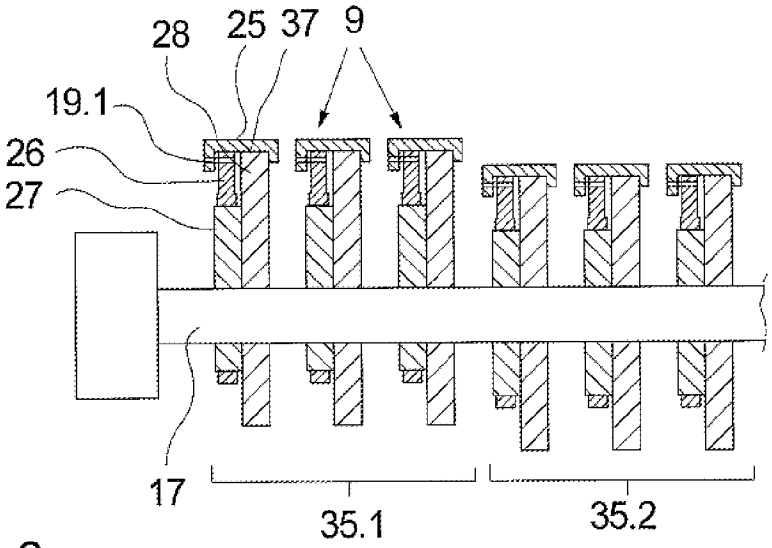
FIG. 6 is a schematic cross-sectional view of the drive shaft of the embodiment of the clamping mechanism in FIG. 5.

For further explanation of the clamp drive 11, reference is also made to FIGS. 5 and 6. A schematic cross-sectional view of the clamp drive 11 is shown in FIG. 5. FIG. 6 shows a schematic cross-sectional view of the drive shaft of the clamp drive in FIG. 5. Where no explicit reference is made to one of the figures, the following description applies to both figures.

The clamping jaws 9 are arranged in parallel side by side and each is separately connected to the clamp drive 11. The connection of the individual clamping jaws 9 to the clamp drive 11 is expressly shown in the depiction in FIG. 5. In this respect, the connection of the clamping jaws 9 to the clamp drive 11 is first described in greater detail in the following, using the example of one of the clamping jaws 9. The clamping jaw 9 is designed as a bar and a clamp section 24 thereof projects into the casing slot 22. Together with the opposing knife plate 2, the clamp section 24 of the clamping jaw 9 forms the clamping gap 10. The clamp section 24 of the clamping jaw 9 features a clamp end 31 which extends to the cutting edge 3.

The clamping jaw 9 is connected to the clamp drive 11 via a guide section 25. The guide section 25 and the clamp section 24 are designed in this embodiment as a single piece.

In this embodiment, the clamp drive 11 is likewise formed by a mechanical linkage 16 with multiple gear elements 18, which are powered via a drive shaft 17. This produces a superimposed clamping movement and an advancing movement at the clamp jaw 9 via the mechanical linkage 16. Hence, the clamp section 24 is guided in an oscillating manner on an elliptical guide path 20. In order to initiate the advancing movement at the clamping jaw 9, the guide section 25 of the clamp jaw 9 is connected to the drive shaft 17 via a connecting rod 26 and an eccentric plate 27. The eccentric plate 27 is fixed to the drive shaft 17. The connecting rod 26 engages the guide section 25 of the clamping jaw 9 via a pivot 19.1. This allows an essentially vertically oriented advancing movement of the clamping jaw 9 to be produced.

In this example, a superimposed clamping movement is achieved by a cam disk 28 on the perimeter of the drive shaft 17, which acts upon a guide surface 37 of the guide section 25. The cam disk 28 is fixed to the drive shaft 17. Due to the design of the cam disk 28, the clamping jaw 9 may essentially be guided back and forth in a horizontally oriented clamping movement.

In order to enable a linear movement of the clamp section 24 for the advancing movement of the clamping jaw 9, a sliding block 29 is arranged on a lead end 30 of the guide section 25, which is connected to the guide section 25 of the clamping jaw 9 via a further pivot 19.2. The sliding block 29 moves along a guide rail 32, which is located on a rail support 33.

The height-adjustable rail support 33 is suspended in a machine frame 34. In this embodiment, the rail support 33 is supported on a diagonal surface of the machine frame 34, wherein the position of the rail support 33 may be changed by means of an adjustment mechanism 40. In addition, the clearance between the clamp section 24 and the knife plate 2 is defined by the height adjustment of the rail support 33, such that the clamping gap 10 may be adjusted by adjusting the guide rail 32.

As can be particularly seen in the illustration in FIG. 6, the clamp jaws 9 are arranged in parallel, divided into multiple drive units which are operated one after the other by the drive shaft 17. By way of example, two drive units 35.1 and 35.2 for the clamping jaws 9 for this purpose are shown in FIG. 6. Each of the drive units, 35.1 and 35.2 respectively, is formed by three adjoining clamping jaws 9. The clamping jaws 9 of one of the drive units 35.1 or 35.2 are synchronously powered via the corresponding eccentric plates 27 and cam disks 28. The adjacent clamping jaws 9 of the adjacent drive unit 35.2, by contrast, are powered one after the other, such that the clamping jaws 9 of the drive unit 35.2 move asynchronously with the clamping jaws 9 of the drive unit 35.1. For this purpose, the corresponding eccentric plates 27 and cam disks 28 are attached to the circumference of the drive shaft 17 in their angular position, offset by a delay angle. Consequently, the plurality of clamping jaws 9 may be divided into multiple drive units distributed over a working width, such that the fibrous material is both immobilized and transported.

As can be seen in the illustration in FIG. 4, the drive shaft 17 of the clamp drive 11 is powered by an electric motor 38 and a controller 39. The drive shaft 17 may be driven via the controller 39 and the electric motor 38 at various rotational speeds, such that the feed and the clamping frequency are infinitely variable. Here, the clamping frequency is independent of the striking frequency of the striking mechanism 5 since a continuous immobilization predominates across the working width of the fibrous material.

Fibrous materials in a wide variety of widths, thicknesses or densities may be advantageously ground into fine fibers and shreds using the embodiments of the device according to the present disclosure shown Immobilizing and clamping the fibrous material right up to the cutting edge of the cutting mechanism prevents larger, undefined end pieces of the fibrous material from being produced by the striking mechanism. Hence, the combination of the cutting mechanism and the clamping mechanism enables fibrous materials to be ground into uniform and defined shreds. This allows, in particular, for processing of plate-shaped fibrous materials.

LIST OF REFERENCE NUMERALS

1 Cutting mechanism
2 Knife plate
3 Cutting edge
4 Plate support
5 Striking mechanism
6 Striking element
7 Drum
8 Clamping mechanism
9 Clamping jaw
10 Clamping gap
11 Clamp drive
12 Linear drive
13 Fibrous material
14 Feed mechanism
15 Feed drums
16 Mechanical linkage
17 Drive shaft
18 Gear elements
19, 19.1, 19.2 Pivot
20 Elliptical guide path
21 Casing
22 Casing slot
23 Fiber outlet
24 Clamp section
25 Guide section
26 Connecting rod
27 Eccentric plate
28 Cam disk
29 Sliding block
30 Lead end
31 Clamp end
32 Guide rail
33 Rail support
34 Machine frame
35.1, 35.2 Drive unit
36 Drum drive
37 Guide surface
38 Electric motor
39 Controller
40 Adjustment mechanism The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A device for grinding fibrous material, having a cutting mechanism which features a cutting edge extending transversely to the fibrous material, a movable striking mechanism, which cooperates with the cutting mechanism to grind the fibrous material at a short distance from the cutting edge, and a clamping mechanism arranged at the cutting mechanism, by means of which the fibrous material may be clamped in an oscillating manner, wherein the clamping mechanism and the cutting mechanism are arranged opposite one another in a clamping plane to form a clamping gap, wherein the clamping mechanism may be moved back and forth relative to the cutting mechanism in a clamping movement.

2. A device according to claim 1, wherein the clamping mechanism is guided by a mechanical linkage for producing a superimposed advancing movement.

3. A device according to claim 1, wherein the clamping mechanism is formed by multiple adjacent movable clamping jaws, in that the clamping jaws are divided into multiple drive units, and the clamping jaws of adjacent drive units are moved asynchronously and the clamping jaws of one of the drive units are moved synchronously.

4. A device according to claim 3, wherein the clamping jaws of the clamping mechanism in each case may be moved in an elliptical guide path by the mechanical linkage.

5. A device according to claim 2, wherein the mechanical linkage may be powered by a drive shaft and a controllable electric motor, which is connected to a controller.

6. A device according to claim 2, wherein the clamping jaws feature a clamp section and a guide section, in that the clamp section of the clamping jaw is oriented parallel to a knife plate forming the cutting edge of the cutting mechanism and that the guide section of the clamping jaw is connected to gear elements of the mechanical linkage by multiple pivots.

7. A device according to claim 6, wherein the drive shaft features multiple eccentric plates and multiple cam disks, in that one of the eccentric plates on each clamping jaw is connected to one of the pivots by a connecting rod of the clamping jaw, and in that one of the cam disks on each clamping jaw cooperates with a guide surface formed on the guide section of the clamping jaw.

8. A device according to claim 6, wherein in each case, the guide sections of the clamping jaws are connected to one of a multiple sliding blocks, which are moved along a guide rail, by a further pivot on a lead end.

9. A device according to claim 8, wherein the guide rail for the sliding blocks is attached by a height-adjustable rail support, wherein a clearance between the clamp section of the clamping jaw and the knife plate of the cutting mechanism may be adjusted by adjusting the guide rails.

10. A device according to claim 1, wherein the striking mechanism is formed by multiple striking elements arranged on a rotating drum, which are distributed on the circumference of the drum and which are positioned at a short distance from the cutting edge of the cutting mechanism.

* * * * *